United States Patent [19]

Satama

[11] 4,204,409

[45] May 27, 1980

[54] AIR CONDITIONING APPARATUS AND SYSTEM

[76] Inventor: Kauko K. Satama, 245 N. 87th St., Mesa, Ariz. 85207

[21] Appl. No.: 928,296

[22] Filed: Jul. 26, 1978

[51] Int. Cl.[2] ..... F25D 23/00; F25B 27/02; F28D 5/00

[52] U.S. Cl. ..... 62/271; 62/238; 62/305; 62/DIG. 16

[58] Field of Search ..... 62/DIG. 16, 91, 259 C, 62/263, 305, 238; 165/48; 98/31

[56] References Cited

U.S. PATENT DOCUMENTS

| | | | |
|---|---|---|---|
| 2,118,949 | 5/1938 | Scott | 62/DIG. 16 |
| 2,156,293 | 2/1939 | Kaufman | 62/271 |
| 2,295,983 | 9/1942 | Williams | 62/305 X |
| 2,323,511 | 7/1943 | Baker | 62/305 X |
| 2,655,795 | 10/1953 | Dyer | 62/305 X |
| 2,892,324 | 6/1959 | Quick | 62/238 R |
| 3,108,451 | 10/1963 | Clifford | 62/305 X |
| 3,989,098 | 11/1976 | Takasaki | 62/DIG. 16 |
| 4,056,946 | 11/1977 | Bond et al. | 62/305 X |
| 4,107,942 | 8/1978 | Fairman | 62/305 |

*Primary Examiner*—Lloyd L. King
*Attorney, Agent, or Firm*—Warren F. B. Lindsley

[57] ABSTRACT

An adjunct apparatus or equipment for use in conjunction with refrigeration air conditioner utilizing the air conditioner condensing coil fan for its original purpose and also for moving water evaporation cooled air through exterior wall air spaces, if any, and/or attic space of a building to reduce the heat load on the air conditioned dwelling space.

5 Claims, 10 Drawing Figures

AIR CONDITIONING APPARATUS AND SYSTEM

BACKGROUND OF THE INVENTION

This inventon relates to auxiliary apparatus and systems to be used with refrigeration air conditioners or heat pumps in the cooling mode to move ambient and water evaporation cooled air across the condensing coils of the refrigeration air conditioner, as required, and through the exterior wall air spaces, if any, and/or the attic space of an air conditioned building. The heat load of the air conditioned space is reduced when the evaporation cooled air absorbs the solar heat accumulated in these spaces and pushes said heat to the atmosphere before it can enter the air conditioned space by radiation.

PRIOR ART

There are no known prior art systems which utilize the coil fan motor of a refrigeration system to cool fresh air utilized by this motor and direct this cooled air to a space between the interior and exterior walls and/or ceiling of a building to reduce the temperature of these walls to control the radiating effect of these walls on the occupied interior of the building.

SUMMARY OF THE INVENTION

In accordance with the invention claimed, auxiliary equipment for use with refrigeration type air conditioners and heat pumps is disclosed and claimed to reduce air conditioner operating and maintenance costs as a result of a reduced heat load on the air conditioned space and because of shorter air conditioner operating periods or cycles.

It is, therefore, one object of this invention to provide auxiliary equipment to improve air conditioner operation and to utilize the air movement generated by the condensing coil fan of a refrigeration air conditioning system to carry off heat from exterior wall air spaces, if any, and/or attic space of an air conditioned building.

Another object of this invention is to provide the apparatus for water evaporation cooling of the air moved across the Freon condensing coils and into the exterior wall air spaces, if any, and/or the attic space of a building to better absorb and remove the solar heat accumulated in these spaces and thus reduce the heat load on the dwelling space within the building.

A further object of this invention is to improve the air conditioner operation by cooling the air moved across the condensing coil to cause more rapid condensation of the Freon discharged from the air conditioner's compressor. As a result, the compressor will operate against a reduced back pressure and the operating periods will be of shorter duration.

A still further object of this invention is to provide an improved air conditioning system which utilizes more effectively the fan coil motor of a refrigeration air conditioner drawing between 4 to 7 amperes to reduce the operating cycle time of its compressor drawing between 20 and 30 amperes.

A still further object of this invention is to provide an improved air conditioning system utilizing more effectively evaporation cooling in combination with a refrigeration apparatus.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
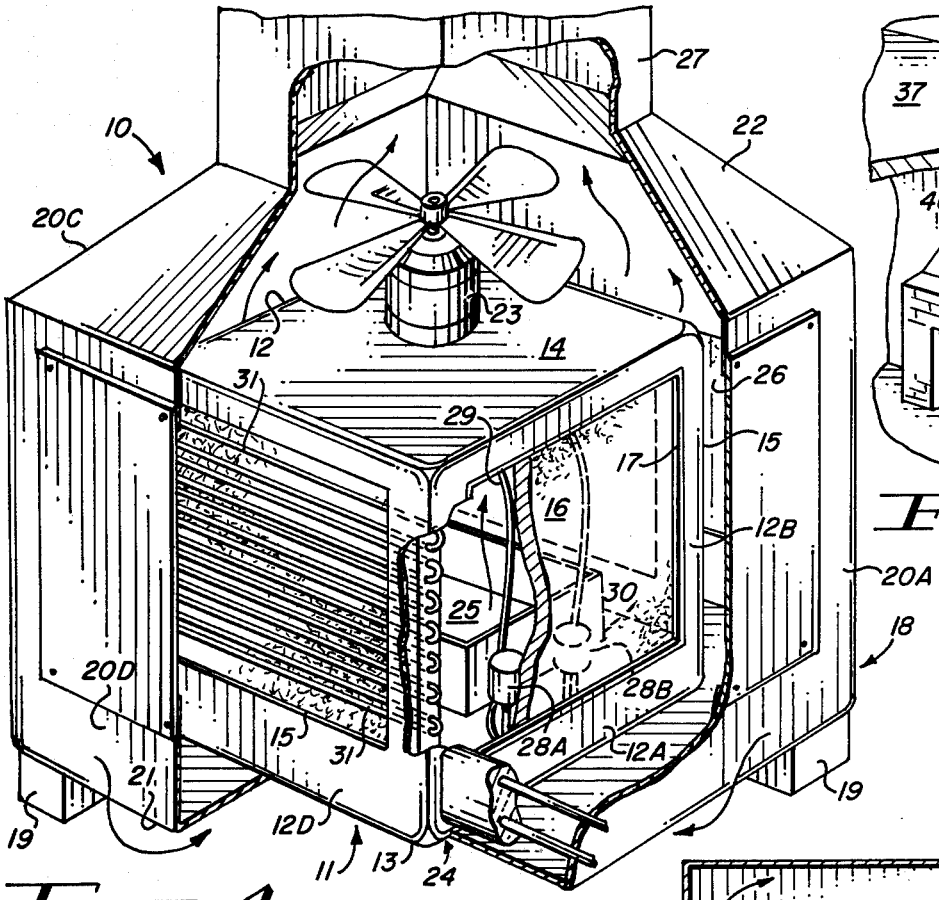
FIG. 1 is a perspective view of an air conditioning system embodying the invention.

Referring more particularly to the drawings by characters of reference, FIG. 1 discloses an air conditioning apparatus 10 comprising an inner rectangular or square shaped chamber 11 formed by four walls 12A, 12B, 12C and 12D, a bottom 13 and top 14. Each of the walls are arranged to receive in a juxtapositioned arrangement a frame 15 containing a wetable fibrous material 16 covering a window 17 in the frame.

Chamber 11 is coaxially positioned within an outer chamber 18 which is mounted on four legs 19 one arranged at each corner of chamber 18 positioning it a small distance above a supporting surface. Chamber 18 comprises four walls 20A, 20B, 20C and 20D, a bottom 21 and a hooded top 22. An electrically driven multi-speed air movement fan 23 may be mounted on top 14 of chamber 11 in the interior of the hooded portion 22 of chamber 18 for drawing air upwardly through an opening 24 in the bottom 21 of chamber 18 and through a channeled opening 25 in the bottom 13 of chamber 11, the fibrous material 16 in frames 15 and into the opening or space 26 existing between the spaced axially arranged chambers 11 and 18 if apparatus 10 is not used in combination with an already existing air conditioning refrigeration unit. From this space 26 extending around all sides of chamber 11, the air is drawn upwardly into the hooded portions 22 of the top of the chamber 18 and into an air duct 27.

In order to cool this air, it is desirable to continually wet the fibrous material 16 in frames 15 with water as long as the suction fan 23 is operating. This wetting function is accomplished by one or more pumps 28A and 28B each connected to a source of water and having a pressure line 29 connected to a suitable trough similar to that shown in FIG. 3 at the tops of frames 15 which distribute the water along the tops of the fibrous material in the same manner as the known evaporative coolers with spacedly positioned outlets in the troughs so that the water can penetrate the fibrous material under the action of gravity, the residual of which drops into the tray formed by the top surface of bottom 13 of chamber 11, the inside walls of sides 12A–12D and the outside surface of the flange 30 forming opening 25 in the bottom of chamber 11.

Since it is intended that the claimed air conditioning apparatus 10 be used in combination with the known refrigeration cooling system or heat pump, it is provided with a Freon coil 31 forming a part of the refrigeration or heat pump air Freon systems. In the known refrigeration and heat pump systems, air is drawn into the apparatus by the usual coil fan motor to cause movement of the air across and through the Freon coils to control the temperature of the Freon in the coils and is normally exhausted to atmosphere.

In accordance with the teachings of this invention, the suction or pressure created by the condensing coil fan of the known refrigeration systems is more effectively utilized by drawing or forcing this air not only through its Freon coils but also through coils 31 of apparatus 10 and one or more frames 15 and their wet fibrous material 16 of this apparatus where the air is cooled and then directed to the air space, if any, in the exterior walls of a building and/or directly to the space above the ceiling or attic for the purpose of driving the solar heat accumulation in these spaces to the atmosphere or to dissipate its effect by the cool air directed into this air space. This action reduces the heat load of the air conditioned dwelling space.

Figure 2:
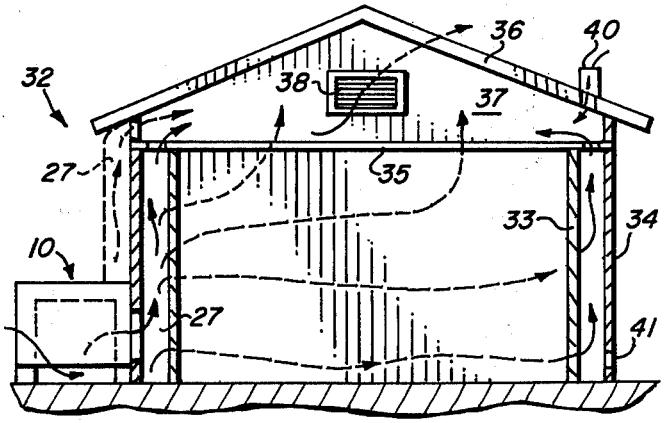
FIG. 2 is a diagrammatic illustration of the cross-section of a building utilizing an air conditioning system of the type disclosed in FIG. 1 for air conditioning the space between the exterior and interior walls and ceiling of a building.

FIG. 2 diagrammatically illustrates the cross-section of a building 32 having air spaces in and between the interior and exterior walls 33 and 34, respectively, a ceiling 35 and a roof 36 enclosing an attic space 37 between the inside surface of the roof and the top surface of the ceiling. The duct 27 shown in FIG. 1 may be directed to the attic space 37 as diagrammatically shown in FIG. 2 or to the space between the interior and exterior walls 33 and 34 at or near the base of the building for movement through this space and out of a vent 38 in attic walls of the building.

Figure 3:
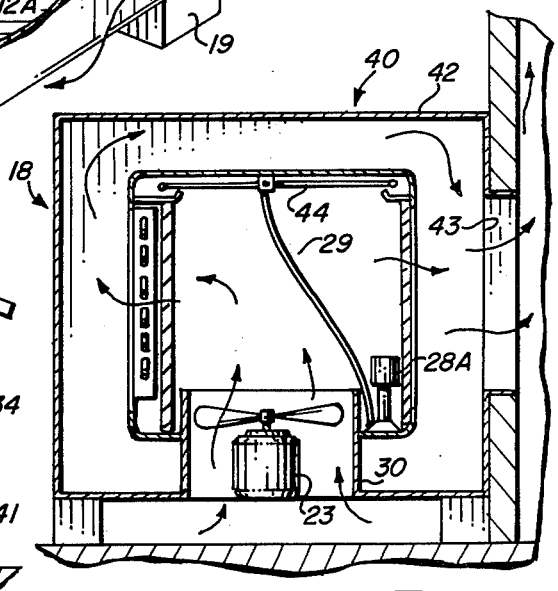
FIG. 3 is a modification of the air conditioning apparatus shown in FIG. 1 utilizing a blower fan for moving air.

If desired, a roof mounted unit 40 similar to that shown in FIG. 3 could be mounted on its side for blowing cool air under pressure downwardly between the interior and exterior walls 33 and 34 and out one or more openings 41 around the foundation of the building, as shown in FIG. 2.

FIG. 3 illustrates a further modification of the air conditioning apparatus 10 shown in FIG. 1 wherein the apparatus 40 comprises some of the same elements, as shown in FIG. 1. These similar elements are given the same reference characters. Apparatus 40 differs from FIG. 1 by embodying the coil fan motor 23 in the entrance flange 30 of the inner chamber 11 in place of the hooded top of the outer chamber 18 as shown in FIG. 1. In this modification, the top 42 of chamber 18 is flat with the air outlet 43 of this apparatus being formed in one of the sides of the outer chamber 18. Water from pump 28A and pressure line 29 flows into a manifold 44 for wetting the fibrous material 16 in frames 15, as heretofore explained.

Figure 4:
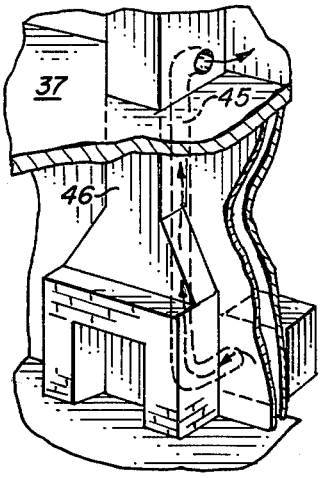
FIG. 4 is a partial view of a building illustrating one means for conducting cool air along and through the chimney structure to the attic of the building.

FIG. 4 diagrammatically illustrates that the cool air from the air conditioning units can be conducted to the attic 37 of the building from apparatus 10 and 40 through a duct 45 attached to or forming a part of the chimney 46 of the building.

Figure 5:
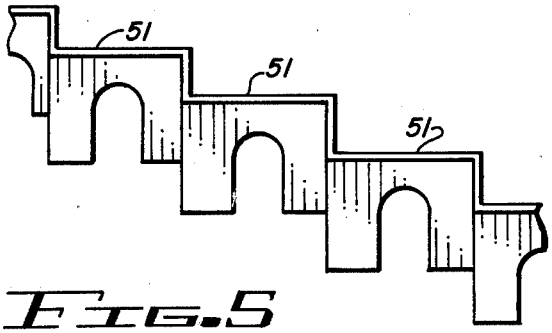
FIG. 5 is a perspective view of an expanded fin arrangement for the Freon coils of the air conditioning units shown in FIGS. 1 and 3.
Figure 6:
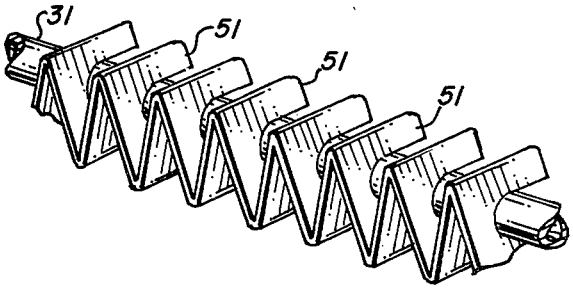
FIG. 6 is a partial perspective view of the fin arrangement shown in FIG. 5 on one of the coils of the units shown in FIGS. 1 and 3.

FIGS. 5 and 6 illustrate an easily cleaned radiating surface for the Freon coil 31 comprising a strip 50 of a plurality of interconnected fins 51. This strip may be formed out of resilient material and cut in an accordian like manner to stretch out over a given length of the coil to substantially increase its radiating surface. If the coil size and length are sufficient to radiate its heat, such fins may not be needed.

Figure 7:
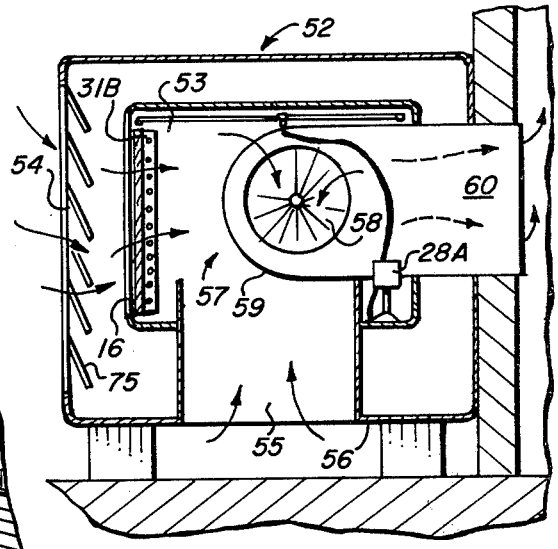
FIG. 7 is a further modification of the air conditioning systems shown in FIGS. 1 and 3 wherein a direct drive blower is utilized inside of the air conditioning unit.

FIG. 7 illustrates a further modification of the air conditioning apparatus shown in FIGS. 1 and 3 wherein the apparatus 52 comprises inner and outer chambers 53 and 54. Air is drawn in through an opening 55 in the base 56 of chamber 54 through one or more frames 15 and associated fibrous material 16 into the interior of chamber 53. Within chamber 53 is mounted a multi-speed motor driven blower 57. This type of blower draws air into one or both sides 58 of its housing 59 and directs it out of housing 59 through an output port or duct 60.

In FIG. 7, the air movement fan or blower 57 first draws air through, independently or in combination with the coil fan motor of refrigeration air conditioner, the Freon condensing coil of the refrigeration air conditioner. The air then enters through the inlet port 55 of the outer chamber of the apparatus or unit 52 and then proceeds through the cooling pads mounted on three or all four walls (depending on fan locating) of the inner chamber 53. On one wall of the inner chamber just downstream of the cooling pad is a Freon condensing coil 31B. In the Freon flow path, the condensing coil 31B is downstream of the condensing coil of the standard refrigeration air conditioner. While only ambient outdoor air flows across the condensing coil 69 of the standard refrigeration air conditioner unit 66, either ambient air or evaporation cooled air may flow across the second condensing coil 31B as determined by thermostat 49 sensing the temperature of the Freon leaving from the second condensing coil.

When the air movement fan 57 is running at low speed, all the air discharged from the apparatus 52 will enter the apparatus by passing across the first condensing coil 31A. When the air movement fan is required to run at high speed as dictated by the outdoor air temperature thermostat 74, the weighted louvers 75 on the walls of the outer chamber will open to supply the additional air that blower 57 can handle at the higher speed and maintain the same air flow rate through the first condensing coil as was maintained when fan 57 was at slow speed.

Figure 8:
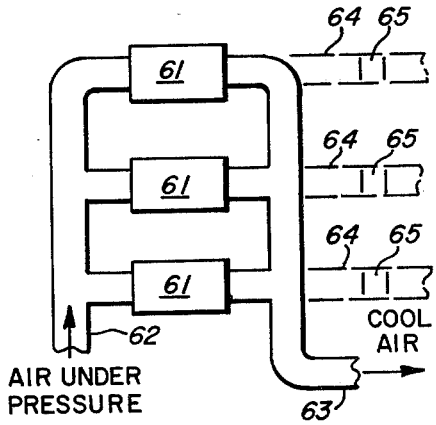
FIG. 8 is a schematic arrangement of a plurality of motorless air conditioning units all supplied from a common source of air under pressure.

FIG. 8 diagrammatically discloses a grouping of three air conditioning units 61 of any of the types disclosed, less their fan coil motors, connected in tandem for receivig air under pressure from a common source 62 and directing their cool air either to a common duct line 63 or individually to separate lines 64, shown in dash lines, to different places as needed in the walls, attic or dwelling space of a building. Each individual line may contain a control valve 65 either manually or electrically controlled.

Although three units 61 are shown, two or more may be combined in any manner, each unit comprising, if so desired, only the evaporation frames 15 and wetting means lacking their individual condensing coil fan.

Figure 9:
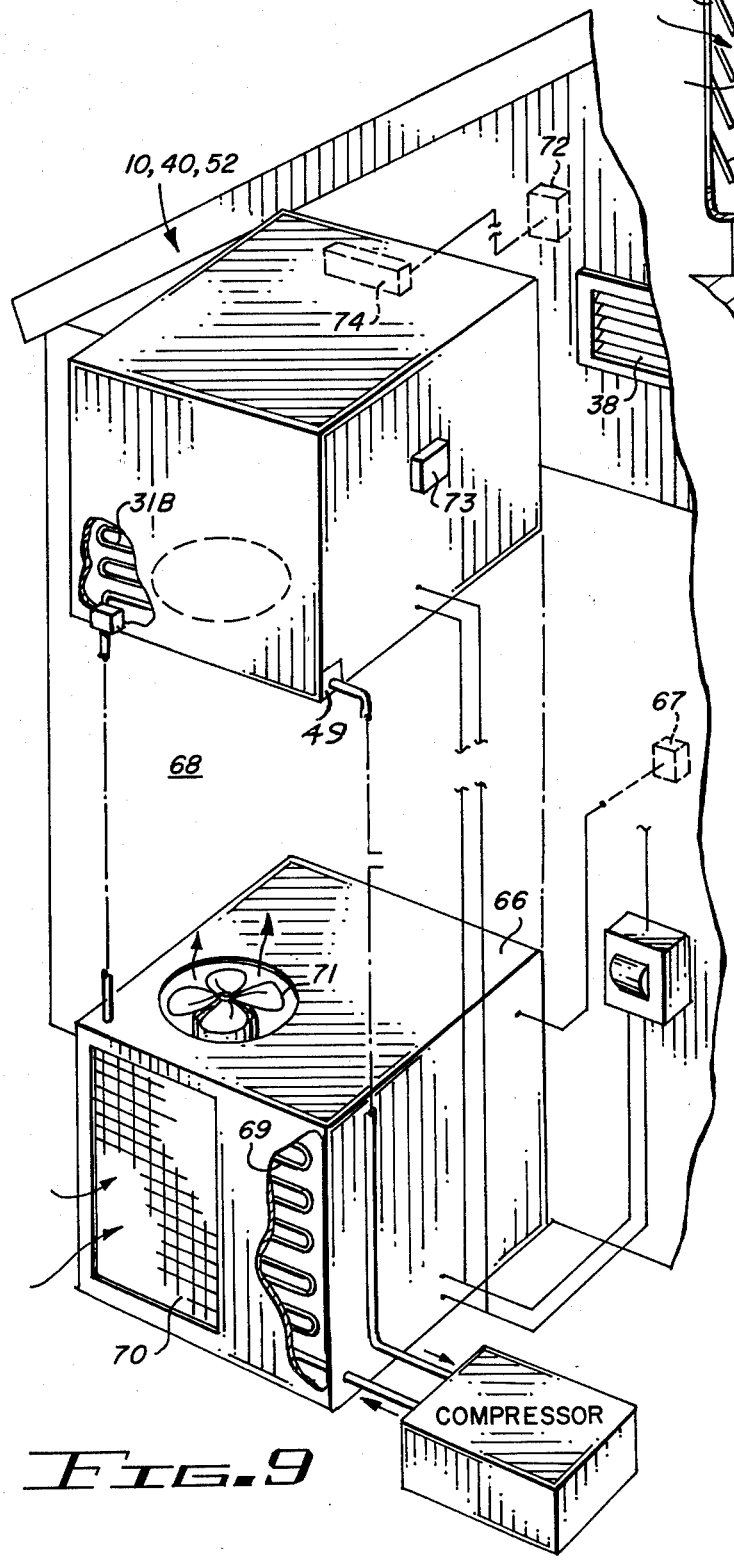
FIG. 9 is a schematic diagram of the thermostatic control of the disclosed air conditioning apparatus and system.

FIG. 9 illustrates diagrammatically in a partially exploded view the association of a standard or known air conditioning unit 66 controlled by the usual indoor thermostat 67 for providing air conditioning of the interior of building 68. This standard unit comprises the usual Freon coils 69 which condenses Freon transmitted to it from the usual compressor forming a part of the air conditioning system of the building. Unit 66 further comprises the usual grill 70 covering an air input opening and a suitable fan 71 for moving atmospheric air through the grill, coils 69 and out of the unit cooling coils 69 and the Freon therein in the process.

The air movement of fan 71 is utilized by one of the disclosed air conditioning units 10, 40 or 52 which may or may not contain its own air movement fan means.

For purposes of illustration, the structure of FIG. 9 will be assumed to contain its own fan moving means which will operate in conjunction with the fan 71 of unit 66. As noted, the air movement of unit 66 is directed into a suitable air entrance port of the units 10, 40 and 52 which will hereafter in this discussion be considered to be the apparatus 52 as shown in FIG. 7.

FIG. 9 further illustrates diagrammatically the electrical connections and thermostatic controls to obtain optimum operation of the proposed air conditioning units represented, for example, by unit 52 to realize more efficient cost operation of the refrigeration type air conditioning unit 66.

An attic thermostat 72 is wired to switch on or off blower motor 57 and either one of the water pumps 28A or 28B whenever the attic temperature exceeds or falls below a set point temperature.

The Freon temperature sensing thermostat 49 of unit 66, which also may be positioned adjacent coils 31 of unit 52, will switch on either pumps 28A or 28B of unit 52 whenever the Freon temperature exceeds or falls below a set point temperature.

An outdoor air temperature sensing thermostat 73 is provided which will switch blower fan 57 to either high or low speed whenever the outdoor air temperature exceeds or falls below a set point temperature.

To accomplish the various switching arrangements in response to signals received from thermostats 49, 72 and 73, an electrical control box 74 is provided in units 10, 40 and 52 to accomplish the functions described above. Since the electronic switching arrangements are not novel, they will not be described herein.

Figure 10:
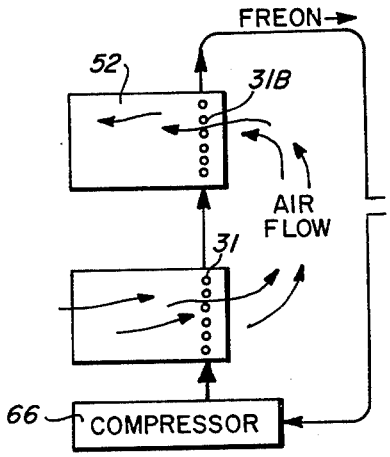
FIG. 10 is a schematic diagram of the air flow and Freon flow through a standard refrigeration air conditioning apparatus in combination with the claimed apparatus.

FIG. 10 is a diagrammatic illustration representing the air and Freon flows between the standard air conditioning unit 66 and the novel and claimed unit 52 shown in FIG. 9.

It should be noted that a rising attic air temperature would cause thermostat 72 to start blower fan motor 57 and would also start one of the two water pumps 28. Outdoor air temperature sensing thermostat 73 would determine whether blower 57 ran at low speed or high speed. When the outdoor air temperature is below a set temperature, the air movement blower 57 would run at low speed, and when the air temperature was above the set temperature, blower 57 would run at high speed.

Water pump 28A would pump water to all four evaporative cooling pads while pump 28B would pump water to three evaporative cooling pads not including the evaporative cooling pad upstream of the second condensing coil 31B. The purpose of switching between pumps 28A and 28B is to prevent super cooling of the condensed Freon.

Whenever the attic temperature so dictated, blower 57 would run to provide evaporation cooled air to carry heat away from the building attic space and the air spaces, if any, inside the exterior walls. It would also provide evaporation cooled air to the second Freon condensing coil 31B whenever the temperature of the Freon leaving coil 31B was higher than the set point of thermostat 49. The cooled air passing across coil 31B will reduce the backpressure of the air conditioner's compressor and thus shorten each operating period and thereby obtain lower air conditioner operating costs and lower air conditioner maintenance costs.

It should be recognized that although the cooling cycle has been disclosed for cooling the air spaces, if any, inside the exterior walls and attic of a building, this same space may be heated thereby heating the building by merely blowing warm air into these spaces from a suitable source.

In accordance with the objects of the invention, a novel and effective cooling system is disclosed for the interior of buildings wherein the temperature of the space between the interior and exterior walls and the attic space is controlled. It will be recognized that while but a few embodiments of the invention have been illustrated and described, it will be apparent to those skilled in the art that various changes and modifications may be made therein without departing from the spirit of the invention or from the scope of the appended claims.

Thus, a new and improved air conditioning system is provided which may increase, at times, the running time of the fan coil motor drawing only between 4 and 7 amperes of electrical current, but reducing the cycle time of operation of the associated compressor drawing between 20 and 30 amperes of electrical current thereby greatly reducing the power costs to air condition the dwelling space of a building equipped as herein described.

It should be recognized that when a heat pump is utilized in the winter time, the air passing over the Freon coils is directed to atmosphere rather than through the walls or attic space as heretofore described to prevent unwanted cooling of the dwelling space.

What is claimed is:

1. An apparatus for air conditioning the interior of a building comprising:

a refrigeration appartus comprising a first coil for the movement of a refrigerant therethrough and a fan motor for directing a stream of atmospheric air over said first coil for cooling the refrigerant, a pair of spaced axially arranged chambers, means for providing an air inlet port in the surface of one of said chambers and an air outlet port in the surface of the other of said chambers, the inner chamber of said pair of chambers being provided with at least one opening covered by a fibrous material, means for selectively wetting said fibrous material with water, a second coil connected to said first coil and juxtapositioned to and downstream of said fibrous material for conducting the refrigerant from said first coil therethrough in a closed circuit configuration, air movement means connected to said apparatus for directing said air passing over said first coil into one of said chambers, through said fibrous material and over said second coil out said outlet port, said air being cooled by water evaporation when passing through said fibrous material, and means for directing said air cooled by water evaporation between the interior and exterior walls of a building to reduce the temperature of these walls.

2. The apparatus set forth in claim 1 wherein:

said air movement means comprises an electrically operated blower mounted within said inner chamber for drawing air through said inlet port in the outer chamber, said fibrous material and said second coil and out of said outlet port formed in the inner chamber.

3. The apparatus set forth in claim 1 wherein:

said air movement means comprises a suction fan mounted in the space between said chambers for drawing air through said air inlet port formed to extend through the outer chamber into the inner chamber of said pair of chambers and through said fibrous material and over said second coil and out an output port in one of the surfaces of said outer chamber.

4. The apparatus set forth in claim 1 wherein:

the inner chamber of said pair of chambers is provided with the air inlet port extending through a surface of the outer chamber of said pair of chambers, and said air movement means comprises a blower mounted in said inlet port, whereby air drawing into said inner chamber by said blower is forced through said fibrous material, said coil and out the outlet port formed in one of the surfaces of said outer chamber.

5. The apparatus set forth in claim 1 in further combination with:

a first control means for selectively energizing said air movement means for moving air and for energizing said air wetting means for cooling air moving therethrough, a second control means for selectively moving air through the apparatus at a greater or lesser cubic feet per minute rate, and a third control means for wetting or not wetting said fibrous material in response to the temperature of the refrigerant in said coil first.

* * * * *

UNITED STATES PATENT OFFICE

CERTIFICATE OF CORRECTION

Patent No. 4,204,409 Dated May 27, 1980

Inventor(s) Kauko K. Satama

It is certified that error appears in the above-identified patent and that said Letters Patent are hereby corrected as shown below:

Column 8, claim 5, line 25,
After coil, cancel "first".

Before coil, insert ---first---.

Signed and Sealed this

*Twelfth* Day of *August 1980*

[SEAL]

*Attest:*

SIDNEY A. DIAMOND

*Attesting Officer*

*Commissioner of Patents and Trademarks*